US006318605B1

(12) United States Patent
Nyman et al.

(10) Patent No.: US 6,318,605 B1
(45) Date of Patent: Nov. 20, 2001

(54) PRODUCT DISPENSING SYSTEM AND METHOD

(75) Inventors: Henry H. Nyman, York, PA (US); Aleksey Zats, Fair Lawn, NJ (US)

(73) Assignee: Paradigm Packaging, Inc., Saddle Brook, NJ (US)

( * ) Notice: Subject to any disclaimer, the term of this patent is extended or adjusted under 35 U.S.C. 154(b) by 0 days.

(21) Appl. No.: 09/678,824

(22) Filed: Oct. 4, 2000

Related U.S. Application Data

(60) Provisional application No. 60/221,342, filed on Jul. 26, 2000.

(51) Int. Cl.[7] ..... B67D 3/00
(52) U.S. Cl. ..... 222/517; 215/305
(58) Field of Search ..... 222/517; 220/334; 215/305, 320, 321, 256

(56) References Cited

U.S. PATENT DOCUMENTS

| | | | | |
|---|---|---|---|---|
| 3,441,161 | | 4/1969 | Van Baarn | 215/40 |
| 3,791,551 | | 2/1974 | Madeira | 220/60 |
| 3,804,286 | | 4/1974 | Watson et al. | 220/27 |
| 3,934,751 | | 1/1976 | Green et al. | 220/306 |
| 3,991,904 | * | 11/1976 | Davis et al. | 220/334 |
| 4,010,875 | * | 3/1977 | Babiol | 222/517 |
| 4,130,220 | | 12/1978 | McKirnan | 220/284 |
| 4,135,638 | | 1/1979 | Wandl | 220/284 |
| 4,165,018 | | 8/1979 | Giggard | 220/284 |
| 4,220,284 | | 9/1980 | Wilson et al. | 215/235 |
| 4,244,495 | | 1/1981 | Lorscheid et al. | 222/153 |
| 4,278,178 | | 7/1981 | Geiser | 215/215 |
| 4,513,888 | | 4/1985 | Curry | 222/153 |
| 4,625,898 | | 12/1986 | Hazard | 222/517 |
| 4,711,360 | | 12/1987 | Ullman | 222/235 |
| 5,271,536 | | 12/1993 | Wilson | 222/498 |
| 5,337,912 | | 8/1994 | Jochem | 220/306 |
| 5,788,107 | | 8/1998 | Meyer et al. | 220/284 |

* cited by examiner

*Primary Examiner*—Philippe Derakshani
*Assistant Examiner*—Thach H Bui
(74) *Attorney, Agent, or Firm*—Mark S. Leonardo, Esq.; Peter B. Sorell, Esq.; Brown Rudnick Freed & Gesmer, PC

(57) ABSTRACT

A dispenser is provided which includes a container having a closed end that defines an orifice. A closure is mountable about the closed end and has a closing lid portion which includes an orifice plug configured to sealingly engage the orifice. The closure includes a retention collar moveably connected and disposed about an outer surface of the container to facilitate mounting. The closing lid portion is moveably connected to the retention collar. The closure further includes a tamper evident portion that removably connects the closing lid portion and the retention collar to provide a first visual indication. The tamper evident portion is removable to provide a second visual indication. The closed end of the container may have a pair of support posts extending therefrom configured to engage a surface of the closure.

21 Claims, 7 Drawing Sheets

PRODUCT DISPENSING SYSTEM AND METHOD

CROSS-REFERENCE TO RELATED APPLICATION

This application claims priority from Provisional Application Serial No. 60/221,342, filed on Jul. 26, 2000, by Nyman et al., the entire contents of which are hereby incorporated herein by reference.

BACKGROUND

1. Technical Field

The present disclosure relates generally to the field of product dispensing containers, and more particularly, to product dispensing containers having tamper-indicating structure.

2. Description of the Related Art

Various types of product dispensing devices are known. These devices typically include the container and a closure, cap, etc., that provides containment and packaging of a product within a container. The container and/or closure can include a dispensing portion for dispensing of the product. Numerous types of closures are known that provide containment of the product. Typically, the closure portion is molded from plastic, however, a metal-based material may be used. The material used is typically resilient such that the closure can be press-fit over a neck portion of the container. The closure may be threaded onto the container. See, for example, U.S. Pat. No. 3,441,161, the entire contents of which are hereby incorporated herein by reference.

Many products, such as, for example, creams and lotions, are packaged in product dispensing devices whereby the closure, having a dispensing portion, is disposed on one end and a portion that is open disposed adjacent an opposing end. Typically, these product dispensing devices include tube containers which are monolithically formed. Other configurations may use an injection-molded neck section welded to an extruded tube. The closure is mounted to the tube container and filled with the product through the open end. The open end is heat sealed and closed after filling of the tube container with the product.

Many of these product dispensing devices have closures that include disengageable or removable sections that allow opening of the closure so that the product may be dispensed. See, for example, U.S. Pat. No. 3,441,161. These devices, however, can fail to preserve the integrity of the product from fluid and/or gas contamination before and after the disengageable portion is removed and the product is initially used. Further, these type containers may require special tooling and, therefore, cannot be easily and economically made. This increases the manufacturing cost of the product dispensing device.

Product dispensing devices may include tamper evident portions used to preserve the integrity of the product prior to first use. The tamper evident portion provides a visual indicator to a user of whether the integrity of the product contained within the product dispensing device has been compromised. This maintains safety and quality of the product to the user.

Typically, tamper evident portions employ a heat sealed foil liner that must be removed before dispensing the product. This procedure includes removing or disengaging the cap from the tube container and then removing the foil liner. The foil liner, however, may be difficult to remove from the tube container due to heat sealing. The foil must then be punctured or otherwise, which can impair the integrity of the product or cause injury to a user. Further, heat sealing adds to the cost of manufacture. Other tamper evident means may include celon bands, glued cartons, tamper indicating closure wraps, etc.

Accordingly, a need exists for a linerless product dispensing system having tamper evident structure that advantageously provides an integral dispensing portion for effectively dispensing the product. It is also desirable that the product dispensing system creates a fluid and/or gas tight interface to preserve the integrity of a product contained within the product dispensing system.

It is, therefore, an object of the present disclosure to overcome the disadvantages of the prior art by providing a linerless product dispensing system having tamper evident structure that advantageously provides an integral dispensing portion for effectively dispensing the product. Desirably, the product dispensing system creates a fluid and/or gas tight interface to preserve the integrity of a product contained within the product dispensing system.

It is a further object of the present disclosure to provide a product dispensing system that facilitates mounting of a closure with a container without the need for special tooling.

It is another object of the present disclosure to provide a product dispenser system having structure formed with the closure that maintains the closure in an open position during dispensing of a product.

It is yet another object of the present disclosure to provide a product dispenser system which is easily and efficiently manufactured and assembled.

Objects and advantages of the present disclosure, set forth in part herein and in part will be obvious therefrom, achieve the intended purposes, objects, and advantages through a new, useful and non-obvious configuration of component elements at a reasonable cost to manufacture, and by employing readily available materials. The various embodiments contemplated are gleaned from the present disclosure and realized and attained by means of the instrumentalities and combinations pointed out in the appended claims.

SUMMARY

The present disclosure is directed to a product dispensing system and related methods of assembly, manufacture and use having tamper indicating structure that does not require a liner and advantageously provides an integral dispensing portion for effectively dispensing a product. Desirably, the product dispensing system creates a fluid and/or gas tight interface to preserve the integrity of a product contained within the product dispensing system. Most desirably, the product dispensing system can be used with one-handed operation. These features contribute to product safety.

The product dispensing system enables facile mounting of a closure with a container. The product dispensing system can also have structure formed with the closure that maintains the closure in an open position during dispensing of the product. The components of the product dispensing system are adaptable to existing manufacturing equipment, and due to their uniform design, prevent misalignment, etc. The advantages achieved by the present disclosure are carried out without substantial increases in labor costs, material costs, mold cycle time or tooling complexity.

In one particular embodiment, in accordance with the present disclosure, a dispenser is provided which includes a container having a closed end and defining a longitudinal axis. The closed end defines an orifice. A closure is mountable about the closed end of the container and has a closing lid portion. The closing lid portion includes an orifice plug configured to sealingly engage the orifice of the container. The closure includes a retention collar disposed about an outer surface of the container. The retention collar is configured to facilitate mounting of the closure to the container. The closing lid portion is movably connected to the retention collar. The orifice of the container may define an orifice bead configured to engage the orifice plug of the closure and facilitate sealing engagement therebetween.

The closure further includes a tamper evident portion which is disposed about the closed end of the container. The tamper evident portion is removably connected to the closing lid portion and the retention collar such that the tamper evident portion connects the closing lid portion and the retention collar to provide a first visual indication. The tamper evident portion is removed to provide a second visual indication.

The closed end of the container may have a pair of support posts extending therefrom which are configured to engage a surface of the closure. The container may define a keyway in an outer surface thereof and the closure may include an orientation key formed on an inner surface thereof. The orientation key is receivable within the keyway. The orientation key and the keyway are configured for engagement to facilitate mounting alignment of the container and the closure.

A retention bead can be formed about at least a portion of an outer surface of the container and is positionable adjacent to the closed end of the container. The retention bead of the container is configured to facilitate mounting of the closure to the container. The retention collar of the closure may be configured to engage the retention bead of the container to facilitate fixedly mounting the closure to the container. The retention collar of the closure may be movably connected to the closing lid portion via a hinge member.

In an alternate embodiment, the tamper evident portion may include a tear band that is circumferentially disposed about the closed end of the container. The tear band may removably connect the closing lid portion and the retention collar. The tear band may also connect the closing lid portion and the retention collar to provide a first visual indication. The first visual indication may indicate that the integrity of a product disposed within the container has not been compromised.

The tear band may be removable from the closing lid portion and the retention collar to provide a second visual indication. The second visual indication may indicate that the closing lid portion is movable between a closed position and an open position. In the closed position, the orifice of the container and the orifice plug of the closure may be sealingly engaged. In the open position, the sealing engagement of the orifice of the container and the orifice plug of the closure can be interrupted. Alternatively, the open position can include a range of movement of the closing lid portion between a first position and a second position. In the second position, the closing lid portion can be resiliently biased towards the first position.

A method of using a dispenser is provided. The method includes the steps of: providing a dispenser which includes: a container having an orifice, and a closure including an orifice plug and a tamper evident portion; mounting the closure with the container such that the orifice and the orifice plug are in sealing engagement and the tamper evident portion indicates a first visual indication; and removing the tamper evident portion from the closure to indicate a second visual indication. The step of providing may further include the closure having a closing lid portion and the method may further include a step of manipulating the closing lid portion between a closed position, whereby the orifice of the container and the orifice plug of the closure are in sealing engagement, and an open position whereby the sealing engagement of the orifice of the container and the orifice plug of the closure is interrupted.

BRIEF DESCRIPTION OF THE DRAWINGS

The objects and features of the present disclosure, which are believed to be novel, are set forth with particularity in the appended claims. The present disclosure, both as to its organization and manner of operation, together with further objectives and advantages, may best be understood by reference to the following description, taken in connection with the accompanying drawings, in which:

DETAILED DESCRIPTION OF THE EXEMPLARY EMBODIMENTS

The exemplary embodiments of the dispenser and related methods disclosed herein are discussed in terms product dispensers. It is envisioned, however, that the disclosure is applicable to a wide variety of product dispensers and vessel-type containers which dispense products contained therein. It is believed that the present disclosure finds application with various uses for the storing, dispensing, etc., of products, such as, foodstuffs, medicines, creams, lotions, liquids, etc.

In the discussion which follows, the term "container" refers, but is not limited to, molded plastic vessels having an open end through which a product is packaged and heat sealed to close after filling. It is important to note, however, that the present disclosure is readily applicable to containers and packaging vessels such as tubes, etc., that are provided in a pre-packaged condition containing products to be dispensed.

Figure 1:
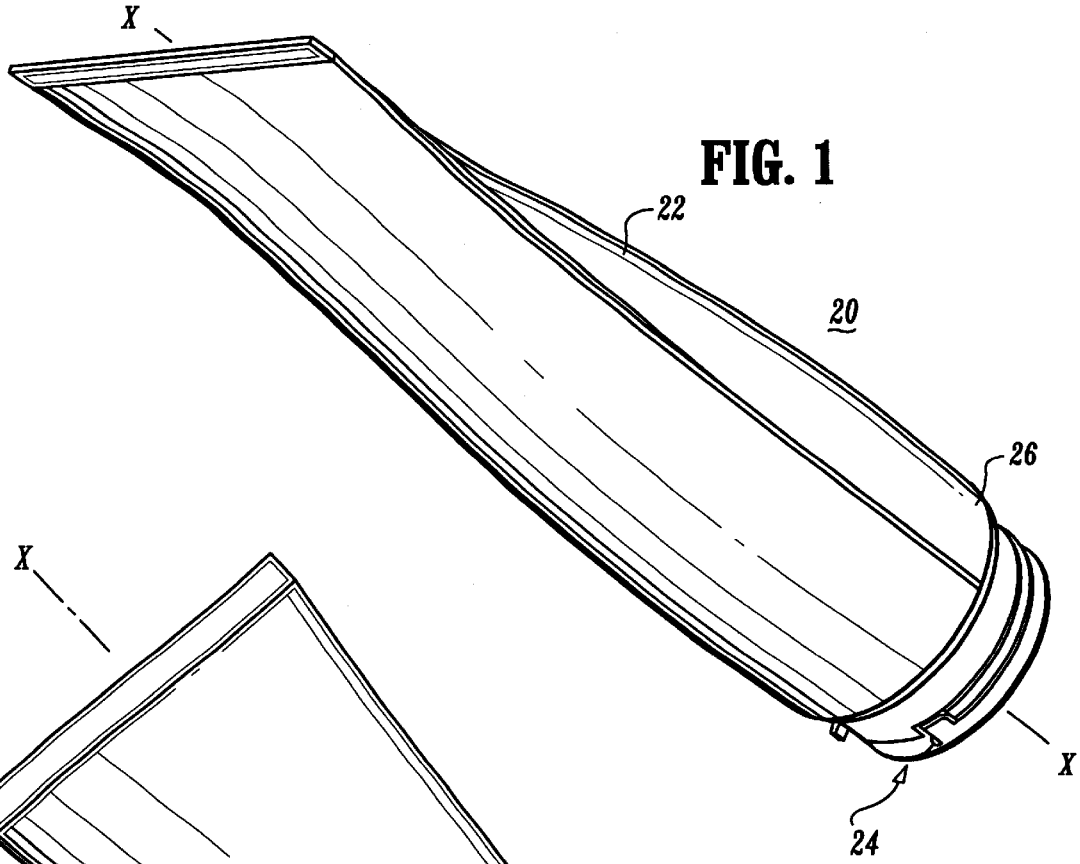
FIG. 1 is a side perspective view illustrating a product dispensing system, in accordance with one embodiment of the present disclosure.
Figure 2:
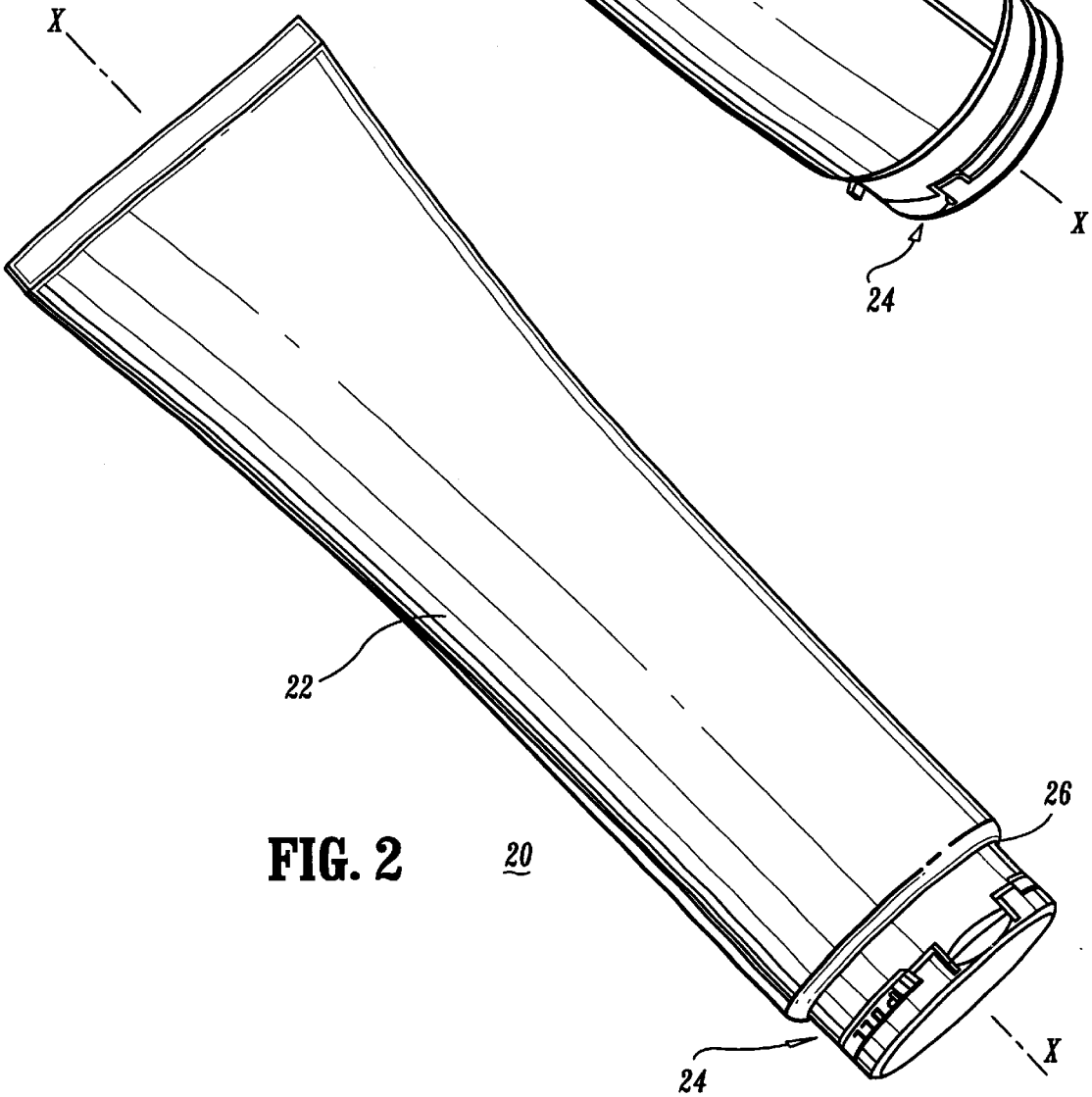
FIG. 2 is a front perspective view of the product dispensing system shown in FIG. 1.

Reference will now be made in detail to the embodiments of the present disclosure that are illustrated in the accompanying figures. Turning now to the figures, wherein like components are designated by like reference numerals throughout the several views, attention is initially directed to FIGS. 1 and 2. A product dispensing system, such as, for example, a product dispenser, shown generally as 20, in accordance with one embodiment of the present disclosure is illustrated. Methods of assembly, manufacture and use of product dispenser 20 are also described. Product dispenser 20 may be used for storing, dispensing, etc., products such as, foodstuffs, medicines, creams, lotions, liquids, etc. Product dispenser 20 advantageously provides a dispensing system having tamper evident structure and an integral dispensing portion for effectively dispensing a product (not shown), discussed below. Product dispenser 20 also provides a design that maintains an open position during dispensing of the product.

Product dispenser 20 includes a tubular plastic container 22 and a closure 24 that is mounted about a closed end 26 of plastic container 22. Plastic container 22 extends along a longitudinal axis x defined thereby. Alternatively, plastic container 22 may not be elongated and may have an increased width along an axis transverse to longitudinal axis x.

Plastic container 22 is molded from suitable plastics appropriate for product dispensing applications. Plastic container 22 is monolithically formed and has a substantially cylindrical configuration. It is contemplated that plastic container 22 may be integrally assembled from multiple components and may have various configurations, such as, for example, rectangular, etc. Plastic container 22 may, alternatively, be fabricated from rigid or semi-rigid materials such as, metal-based materials or plastics which incorporate metal stiffeners in order to provide sufficient rigidity. One skilled in the art, however, will realize that other materials and fabrication methods suitable for assembly and manufacture, in accordance with the present disclosure also would be appropriate.

Figure 4:
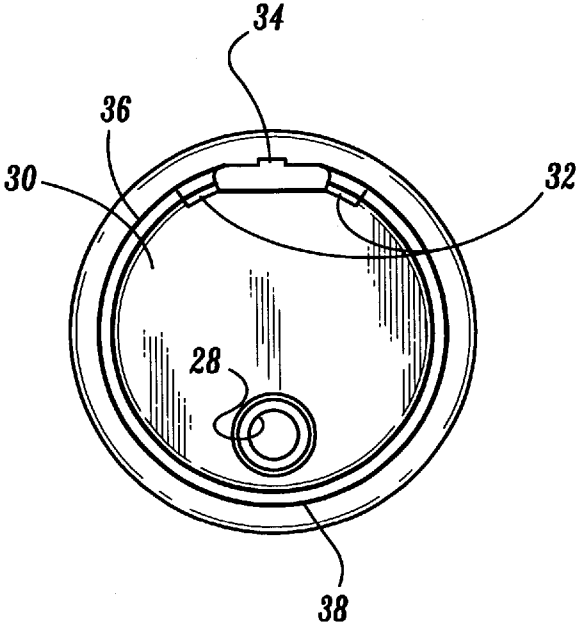
FIG. 4 is a top plan view of the container shown in FIG. 3.
Figure 3:
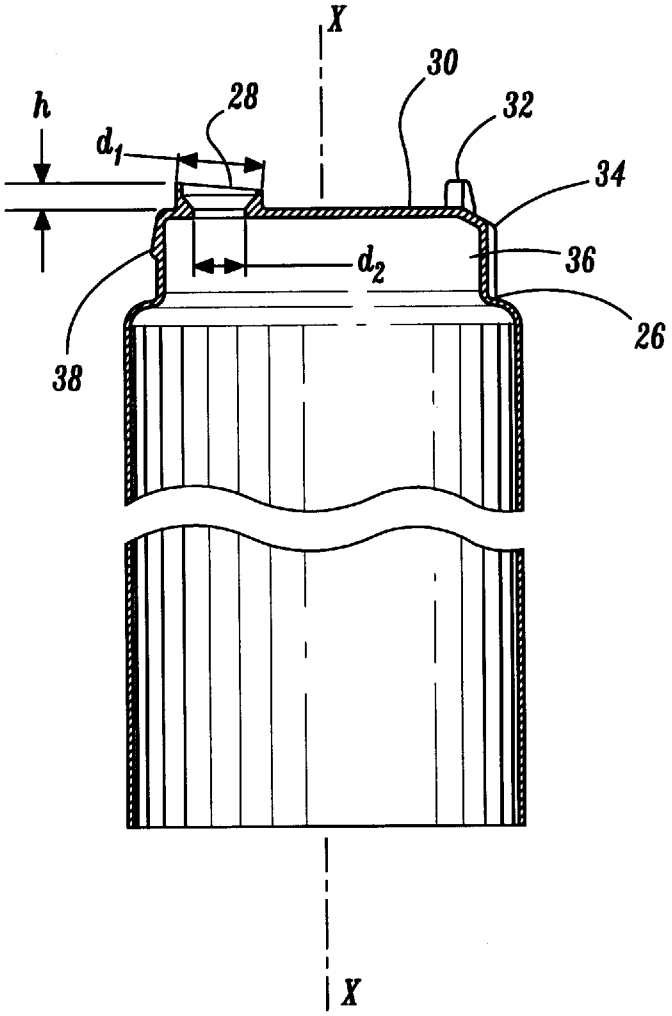
FIG. 3 is a side cross-sectional view, in part elevation, of a container, shown in cutaway, of the product dispensing system illustrated in FIG. 1.

Referring to FIGS. 3 and 4, closed end 26 defines an orifice 28, which is configured such that the product may pass therethrough. Orifice 28 defines an opening in a plane transverse to longitudinal axis x. Orifice 28 is formed in a wall 30 of closed end 26, which is also oriented in a plane transverse to longitudinal axis x.

Orifice 28 is a cylindrical cavity which may be variously dimensioned according to the product dispensing application based on factors such as, for example, flow, dispensing angle, etc. It is envisioned that orifice 28 and/or wall 30 may be oriented at various transverse orientations relative to longitudinal axis x. Orifice 28 may also include screens, slats, etc., and/or have a rectangular, elliptical, etc., configuration according to the application.

Orifice 28 projects from wall 30 a height h. Orifice 28 includes a first diameter d1 and a second diameter d2. First diameter d1 has a larger dimension than second diameter d2, such that orifice 28 has a substantially tapering cross-sectional configuration along height h. The configuration of orifice 28 advantageously provides a releasable sealing engagement with closure 24, discussed in detail below. This provides an integral dispensing portion for effectively dispensing the product from product dispenser 20. It is envisioned that first diameter d1, second diameter d2 and height h may be variously dimensioned to provide a releasable sealing engagement with closure 24, according to a particular dispensing application.

Plastic container 22 includes a pair of support posts 32 extending therefrom. Support posts 32 are formed with and project from closed end 26 of plastic container 22. It is contemplated that only one support post 32 or that multiple support posts may be used. Support posts 32 engage closure 24 and facilitate movement of closure 24 between a closed and an open position, as will be discussed below, as well as facilitating dispensing of the product.

An orientation keyway 34 is longitudinally formed in an outer surface 36 of plastic container 22 adjacent closed end 26. Orientation keyway 34 facilitates alignment and retention of closure 24 with plastic container 22, discussed in more detail below. It is envisioned that orientation keyway 34 may extend variable lengths along plastic container 22, may be oriented transverse to longitudinal axis x and/or include multiple keyways 34, according to the particular product dispensing application.

A retention bead 38 is formed in outer surface 36 adjacent closed end 26. Retention bead 38 projects radially outward about a circumferential portion of plastic container 22 adjacent orifice 28. It is envisioned that retention bead 38 may be variously positioned about the circumference of closed end 26, or alternatively, retention bead 38 may be disposed about substantially all of closed end 26. Retention bead 38 engages closure 24 to facilitate maintaining closure 24 in the closed position. This feature of the present disclosure advantageously reduces tooling complexity and facilitates adaptability to existing manufacturing equipment. Retention bead 38 is disposed diametrically from orientation keyway 34 to facilitate manipulation of closure 24 in the open position.

Figure 6:
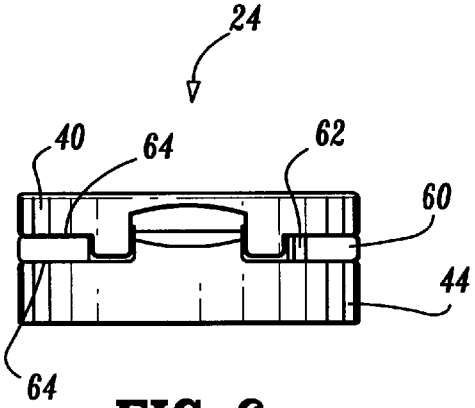
FIG. 6 is a front plan view of the closure shown in FIG. 5.
Figure 7:
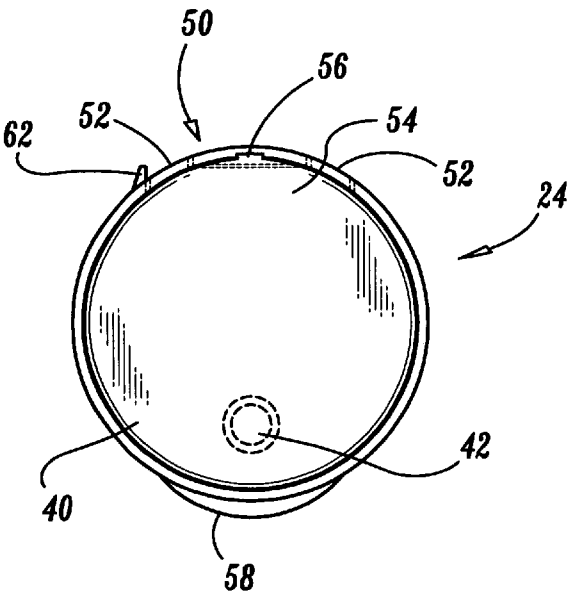
FIG. 7 is a top plan view of the closure shown in FIG. 5, illustrating particular components thereof in phantom.
Figure 5:
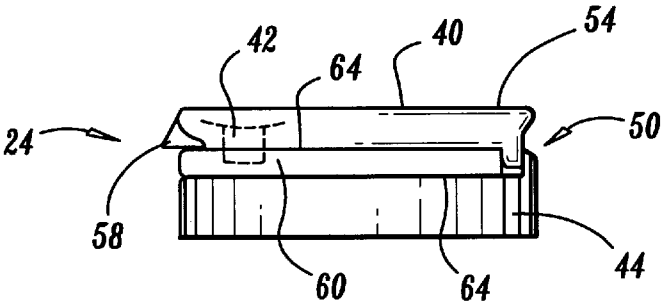
FIG. 5 is a side plan view of a closure of the product dispensing system shown in FIG. 1.

Referring to FIGS. 5–7, closure 24 is substantially cylindrical and molded from suitable plastics. It is envisioned that closure 24 may be integrally assembled of its constituent components and may have various configurations, such as, for example, rectangular, etc. Closure 24 is fabricated from a semi-rigid material with sufficient flexibility for assembly with plastic container 22. Plastic container 22 and closure 24 are correspondingly molded for integral assembly therewith. One skilled in the art, however, will realize that other materials and fabrication methods suitable for assembly and manufacture, in accordance with the present disclosure, also would be appropriate.

Closure 24 is mounted about closed end 26 (FIG. 3) of plastic container 22 and has a closing lid portion 40 having a substantially flat configuration. It is envisioned that closing lid portion 40 may also be domed, etc. Closing lid portion 40 includes an orifice plug 42 (shown in phantom) configured for releasable sealing engagement with orifice 28 of plastic container 22.

Orifice plug 42 engages the inner surfaces of orifice 28 to form a releasable seal thereby creating a fluid and/or gas tight interface therebetween to preserve the integrity of the product contained within product dispenser 20, as well as prevent product leakage. This feature of the present disclosure advantageously prevents contaminants from entering plastic container 22 or product from exiting plastic container 22.

Closure 24 includes a retention collar 44 disposed about outer surface 36 (FIG. 3) of plastic container 22. Retention collar 44 includes a retention bead 46 (shown clearly in FIG. 8). Retention bead 46 is formed about a circumferential portion of an inner surface 48 of closure 24. Retention bead 46 is configured to fixedly engage retention bead 38 (FIG. 3) of plastic container 22 to facilitate mounting of closure 24 to plastic container 22, as will be discussed below. It is contemplated that retention bead 46 may be variously disposed about the circumference of retention collar 44 or, alternatively, may be formed about substantially all of retention collar 44. Retention bead 46 is correspondingly formed about retention collar 44, such that upon engagement of closure 24 with plastic container 22, retention bead 46 engages retention bead 38 of plastic container 22 to facilitate mounting thereof.

Closure 24 includes a hinge member 50 that facilitates connection of closing lid portion 40 with retention collar 44. Hinge member 50 includes hinge portions 52. Hinge portions 52 provide a flexible connection of closing lid portion 40 with retention collar 44. Hinge member 50 facilitates pivotal movement of closing lid portion 40 about the portion of closure 24 at which closing lid portion 40 is connected to retention collar 44 via hinge member 50. Hinge member 50 is disposed diametrically from retention bead 46 to facilitate movement of closing lid portion 40 between the closed and the open position.

Hinge member 50 is fabricated from a material with sufficient resilient characteristics to facilitate pivotal movement of closing lid portion 40 relative to retention collar 44. It is contemplated that hinge member 50 is monolithically formed with closure 24, has a reduced thickness for flexibility, or, alternatively, may be integrally assembled with closure 24 and fabricated from a suitable elastic material in accordance with the present disclosure.

Hinge member 50 allows closing lid portion 40 to pivot thereabout. A proximal portion 54 of closing lid portion 40 is located adjacent hinge member 50. Proximal portion 54 is configured to interfere with support posts 32 (FIG. 3) of plastic container 22 for advantageously maintaining closing lid portion 40 in the open position during dispensing of the product, as will be discussed in more detail below.

An orientation key 56 is formed on an inner surface 48 (FIG. 8) of closure 24 for alignment with-orientation keyway 34 (FIG. 4) of plastic container 22. Orientation key 56 engages orientation keyway 34 to facilitate orientation and alignment of closure 24 with plastic container 22. Orientation key 56 is slideably received within orientation keyway 34. It is contemplated that multiple orientation keys 56 may be used corresponding to the number of orientation keyways 34. It is envisioned that a single orientation key 56 may be used for engaging multiple variously spaced orientation keyways 34 for adjustable placement of closure 24 with plastic container 22. A thumb tab 58 is formed with closing lid portion 40 to facilitate manipulation of closing lid portion 40. Thumb tab 58 is formed diametrically from hinge member 50 to facilitate pivotal movement of closing lid portion 40 about hinge member 50.

Closure 24 includes a tamper evident portion, such as, for example, a tear band 60 which is circumferentially disposed about closed end 26 (FIG. 3) of plastic container 22. Tear band 60 removably connects closing lid portion 40 and retention collar 44. Tear band 60 is a circumferential strip, which is adapted to be removed by pulling a tab 62 of tear band 60 about the circumference of closure 24. Tear band 60 is connected to closing lid portion 40 and retention collar 44 by wall sections 64. Wall sections 64 are easily ruptured and broken away from closing lid portion 40 and retention collar 44, so that closing lid portion 40 can be manipulated to the open position, discussed below, and the product disposed within plastic container 22 can be dispensed from product dispenser 20.

Tear band 60 is monolithically formed with closure 24. During fabrication, wall sections 64 are formed, such as, for example, by reducing the material thickness of closure 24 at wall sections 64, so that wall sections 64 may be easily ruptured and broken away from closure 24. It is contemplated that tear band 60 may be integrally assembled with closure 24 and subsequently attached by heat treating, etc. It is envisioned that wall sections 64 may be perforated in a subsequent manufacturing operation to facilitate easy rupture from closure 24. Tear band 60 may also be fabricated from other materials suitable for a product dispensing application. One skilled in the art, however, will realize that other materials and fabrication methods suitable for product dispenser manufacture, in accordance with the present disclosure, will also be appropriate.

Product dispenser 20 advantageously includes the tamper evident portion which alerts a consumer if product dispenser 20 has been opened or the product disposed within plastic container 22 has been tampered with. Tear band 60 removably connects closing lid portion 40 and retention collar 44 such that tear band 60 connects closing lid portion 40 and retention collar 44 to provide a first visual indication. The first visual indication indicates to a consumer that the integrity of the product disposed within plastic container 22 has not been compromised. Tear band 60 is removable by having the consumer grasp tab 62 of tear band 60 with a hand (not shown). The consumer then pulls tear band 60 about the circumference of closure 24.

Removal of tear band 60 provides a second visual indication, as will be discussed in more detail below. The second visual indication indicates to the consumer that the integrity of a product disposed within plastic container 22 may have been compromised, i.e., the sealing engagement between orifice 28 and orifice plug 42 has been interrupted and that the product may have been dispensed from product dispenser 20 and/or that contaminants may have entered plastic container 22.

The second visual indication also signals that closed lid 40 is movable between the closed position, whereby orifice 28 of plastic container 22 and orifice plug 42 of closure 24 are in a sealing engagement and the open position, whereby orifice 28 and orifice plug 42 are out of sealing engagement, as will be discussed below. The open position includes a range of movement of closing lid portion 40 between a first position whereby sealing engagement between orifice 28 and orifice plug 42 is interrupted and a second position whereby closing lid portion 40 is resiliently biased towards the first position.

Figure 10:
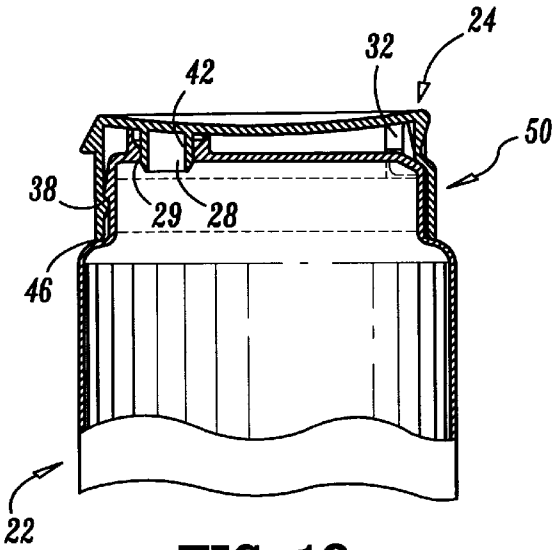
FIG. 10 is a side cross-sectional view, in part elevation, of the product dispensing system illustrated in FIG. 1, shown in cutaway.
Figure 8:
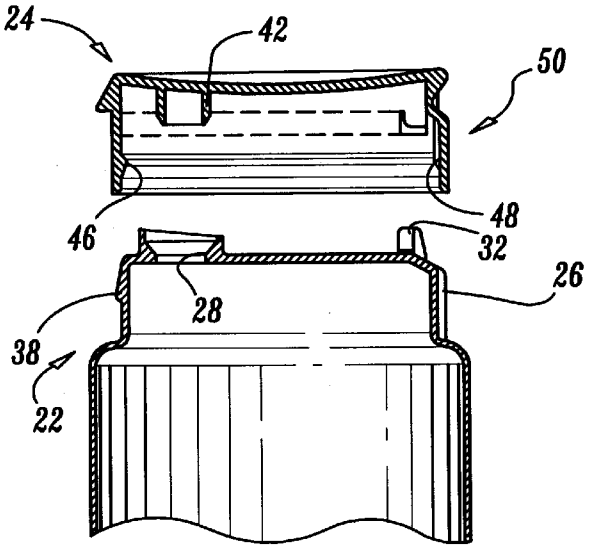
FIG. 8 is a side cross-sectional view, in part elevation, of the product dispensing system illustrated in FIG. 1, shown in cut-away and with parts separated.
Figure 9:
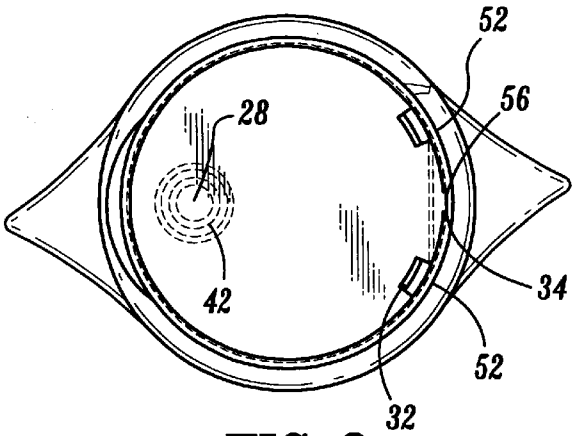
FIG. 9 is a top plan view of the product dispensing system shown in FIG. 1, illustrating particular components in phantom.

Referring to FIGS. 8–10, the assembly of product dispenser 20 will be described. Closure 24 is manipulated into proper orientation for assembly with plastic container 22. As shown in FIG. 8, closure 24 is positioned for placement with closed end 26 of plastic container 22. Closure 24 is oriented such that orientation key 56, as shown in FIG. 9, is aligned with orientation keyway 34 of plastic container 22. Retention bead 46 of closure 24 is aligned with retention bead 38 of plastic container 22. Orifice plug 42 of closure 24 is properly aligned with orifice 28. Hinge portions 52 of hinge member 50 are also properly aligned with support posts 32 of plastic container 22.

With the components of plastic container 22 and closure 24 properly aligned, a force A is applied, in the direction of the arrow shown in FIG. 8, to closure 24. Closure 24 is caused to move in the direction of force A towards plastic container 22 and is properly positioned onto closed end 26 of plastic container 22, as shown in FIG. 10. As closure 24 is mounted to plastic container 22, inner surface 48 of closure 24 is flexible such that closure 24 resiliently biases over closed end 26 in a snug fit thereon. It is contemplated that closure 24 may mount to plastic container 22 in a loose fit provided that orifice 28 and orifice plug 42 create a fluid and/or gas tight interface.

Referring to FIGS. 9 and 10, orientation key 56 matingly engages orientation keyway 34 to facilitate alignment of closure 24 with plastic container 22. Retention bead 46 is caused to snap over retention bead 38 and be positioned beneath retention bead 38 facilitating retention and fixed mounting of closure 24 with plastic container 22.

As retention bead 46 snaps into position beneath retention bead 38, orifice plug 42 engages orifice 28 in a sealing engagement therewith. Orifice 28 includes an orifice bead 29 that engages orifice plug 42. Orifice plug 42 is configured to provide an interference fit with orifice bead 29 to create a fluid and/or gas tight interface there between. This advantageously prevents passage of the product from plastic container 22 to outside of plastic container 22, or contaminants from the outside to the product disposed within plastic container 22, thereby preserving the integrity of the product contained in plastic container 22. It is contemplated that orifice plug 42 may engage orifice 28 in alternative manners, such as, for example, press fit, latching, etc.

Figure 11:
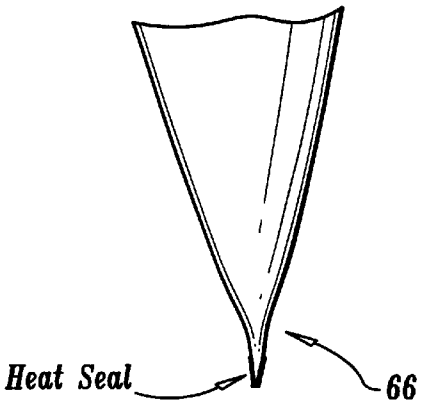
FIG. 11 is a side plan view of an open end of the product dispensing system illustrated in FIG. 1, shown in cutaway during assembly.

Referring to FIG. 11, product dispenser 20 is now properly capped with closure 24 mounted onto closed end 26 of plastic container 22. An open end 66 of plastic container 22 is filled with the product and open end 66 is heat sealed to close end 66 after filling of the product.

Figure 12:
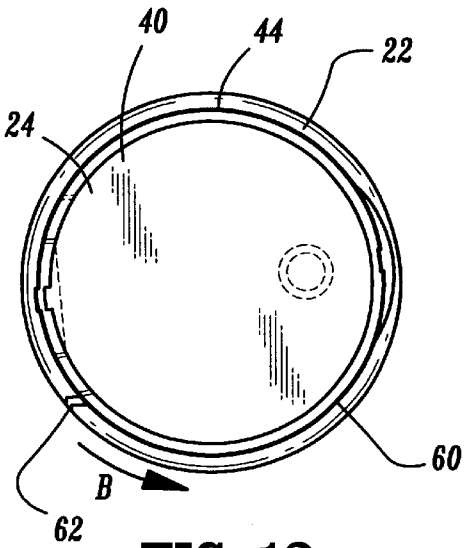
FIG. 12 is a top plan view of the product dispensing system shown in FIG. 1, illustrating use thereof.
Figure 13:
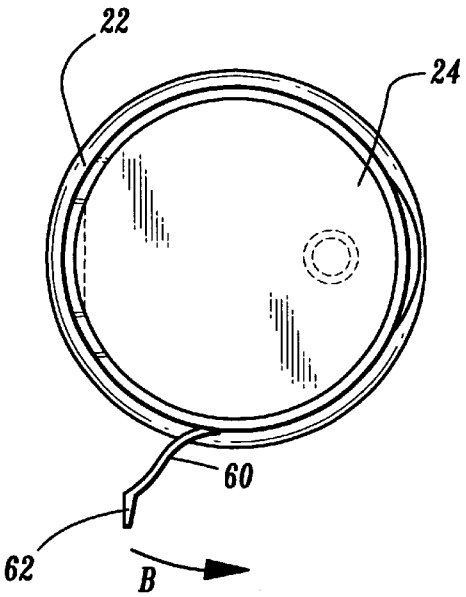
FIG. 13 is a top plan view of the product dispensing system shown in FIG. 1, illustrating use thereof.

Referring to FIGS. 12–15, operation of product dispenser 20 will now be described. Product dispenser 20 is grasped by the hand of the consumer and manipulated for use. As shown in FIGS. 12 and 13, tear band 60 connects closing lid portion 40 and retention collar 44 to provide a first visual indication, described above. This condition of tear band 60 provides a visual indication that the integrity of the sealing engagement formed between orifice plug 42 and orifice 28 has not been compromised. Correspondingly, the product contained within plastic container 22 has not been tampered with or contaminants have not passed therein. Tear band 60 advantageously eliminates the need for problematic tamper indicating devices, such as, for example, a foil liner, celon bonds, glued cartons, etc.

Figure 14:
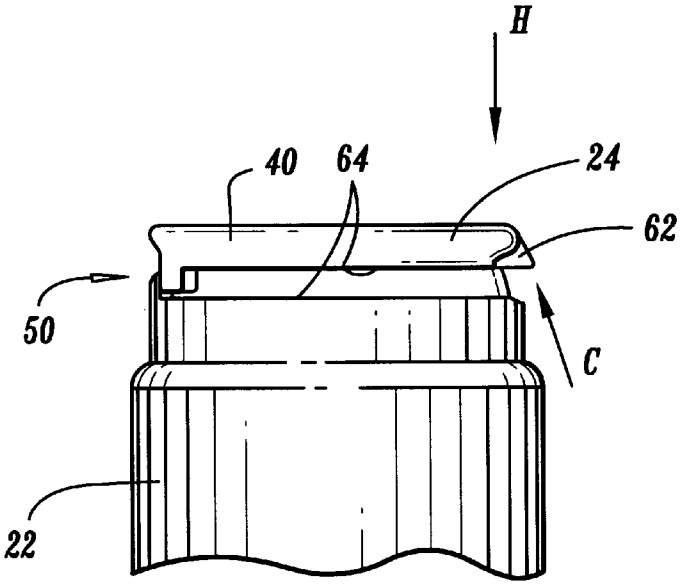
FIG. 14 is a side plan view of the product dispensing system illustrated in FIG. 1, shown in cutaway and having a tamper evident portion removed.

Tab 62 of tear band 60 is grasped by the consumer and manipulated circumferentially about closure 24 for removal from closure 24 and partial separation of closing lid portion 40 and retention collar 44, as described above. Tab 62 is manipulated, in the direction shown by arrow B, causing tear band 60 to rupture and break away from closure 24, while leaving hinge member 50 intact, as shown in FIG. 14. Upon removal of tear band 60, a second visual indication is provided, described above. This indication provides tamper evidence, indicating the possibility that the sealing engagement formed between orifice plug 42 and orifice 28 has been interrupted. Closing lid portion 40 and retention collar 44 are separated adjacent wall sections 64 where tear band 60 has been removed. A connection of closing lid portion 40 and retention collar 44 is maintained by hinge 50.

Figure 15:
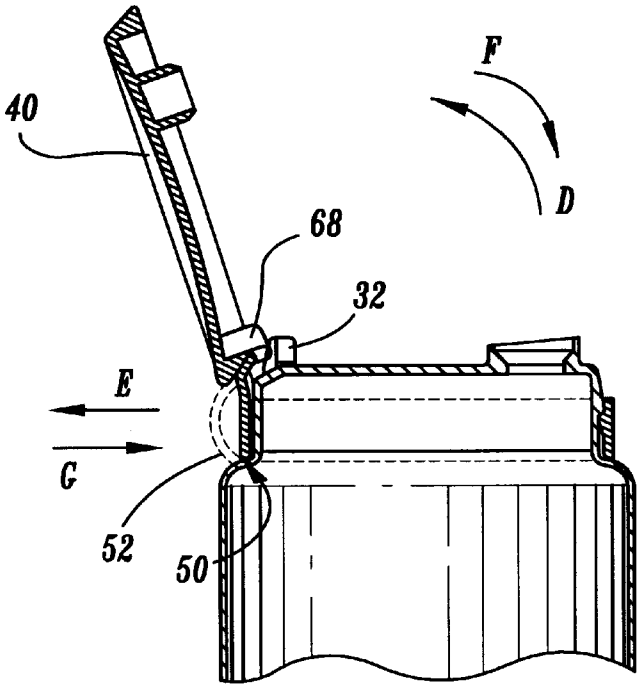
FIG. 15 is a side plan view of the product dispensing system illustrated in FIG. 1, shown in cutaway and having a closing lid portion in an open position.

The second visual indication also indicates to the consumer that closed lid portion 40 is moveable between the closed position, as shown in FIG. 14, and the open position, as shown in FIG. 15. In the closed position, orifice 28 of plastic container 22 and orifice plug 42 of closure 24 maintain a sealing engagement therebetween, described above.

A force C, in the direction of the arrow shown, is applied to the underside of tab 62 of closing lid portion 40. Tab 62 is formed in closing lid portion 40 generally opposite from hinge member 50, such that application of force C to tab 62 causes closing lid portion 40 to pivot about hinge member 50. As force C is applied to tab 62, the retention forces of orifice bead 29 (FIG. 10) of orifice 28 with orifice plug 42 are overcome. The retention forces between retention bead 46 and retention bead 38 are also overcome, causing closing lid portion 40 to be released from engagement from the portion of plastic container 22 adjacent orifice 28 and retention bead 38. Closing lid portion 40 is caused to snap or pop open from plastic container 22. It is contemplated that the snapping and/or popping sound is an audible signal to the consumer that the sealing engagement of orifice 28 and orifice plug 42 is interrupted and closing lid portion 40 is in the open position.

After sealing engagement of orifice plug 42 and orifice 28 is interrupted, closing lid portion 40 is in the open position. In the open position, orifice plug 42 and orifice 28 are out of sealing engagement. The open position includes a range of movement of closing lid portion 40 between a first position and a second position.

In the first position, sealing engagement between orifice 28 and orifice plug 42 is initially interrupted. The product contained within plastic container 22 is permitted to flow from orifice 28 during a particular dispensing application. The range of movement of closing lid portion 40 includes pivotal movement of closing lid portion 40 about hinge member 50, in the direction shown by arrow D, towards the second position.

A proximal surface 68 of closing lid portion 40 is configured to interfere with support posts 32 of plastic container 22. As closing lid portion 40 is manipulated, in the direction of arrow D, the second position within the range of movement of closing lid portion 40 is approached. In the second position, proximal surface 68 is caused to engage and interfere with support posts 32. Correspondingly, hinge portions 52 of hinge member 50 are drawn away or bow in a direction shown by arrow E, as shown in phantom in FIG. 15.

As closing lid portion 40 is further manipulated in the direction shown by arrow D, relative to hinge member 50, proximal surface 68 is caused to travel out of interference and clear support posts 32. When proximal surface 68 of closing lid portion 40 clears support posts 32, the resilient characteristics of hinge portions 52 of hinge member 50 causes closing lid portion 40 to be urged, in the direction shown by arrow F, to engage back with support posts 32. The resilient characteristics of hinge portions 52, however, are insufficient to overcome the interference between support posts 32 and proximal surface 68, thereby preventing closing lid portion 40 from freely moving to the first position. Therefore, closing lid portion 40 remains within the second position whereby proximal surface 68 engages and interferes with support posts 32. Closing lid portion 40 remains in the open position such that the product contained in plastic container 22 may be dispensed from orifice 28.

Closure 24 remains mounted with plastic container 22 during movement of closing lid portion 40 in the open position. Closing lid portion 40 is manipulated to the closed position by having the consumer manipulate closing lid portion 40 such that proximal surface 68 of closing lid portion 40 elastically deforms with support posts 32. Hinge portions 52 deflect, in the direction shown by arrow G, allowing closing lid portion 40 to pivot on hinge member 50, in the direction shown by arrow F, towards the closed position.

Continued manipulation of closing lid portion 40 causes orifice plug 42 to be oriented with orifice bead 29 of orifice 28 for sealing engagement therewith. Closing lid portion 40 is returned to the closed position by applying a force H, in the direction of the arrow shown, as illustrated in FIG. 14, to a top surface of tab 62 and/or a top surface of closing lid portion 40. Orifice plug 42 engages orifice bead 29 to create a fluid and/or gas tight interface with orifice 28. This feature of product dispenser 20 again preserves the integrity of the product contained within plastic container 22. This prevents contaminants from passing through orifice 28 and combining with the product remaining in plastic container 22. It is envisioned that a desirable seal is advantageously provided when orifice plug 42 and closed end 26 of plastic container 22 are fabricated from materials of dissimilar hardness.

Figure 16:
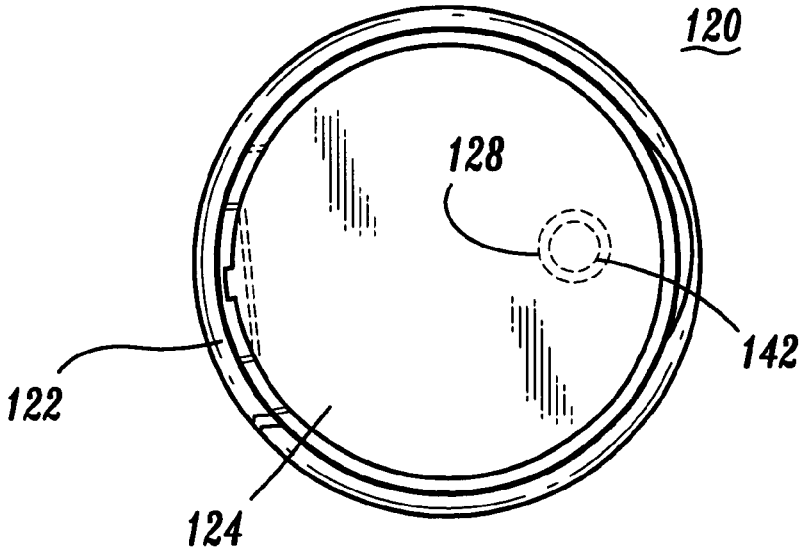
FIG. 16 is an alternate embodiment of the product dispensing system, in accordance with the present disclosure.
Figure 17:
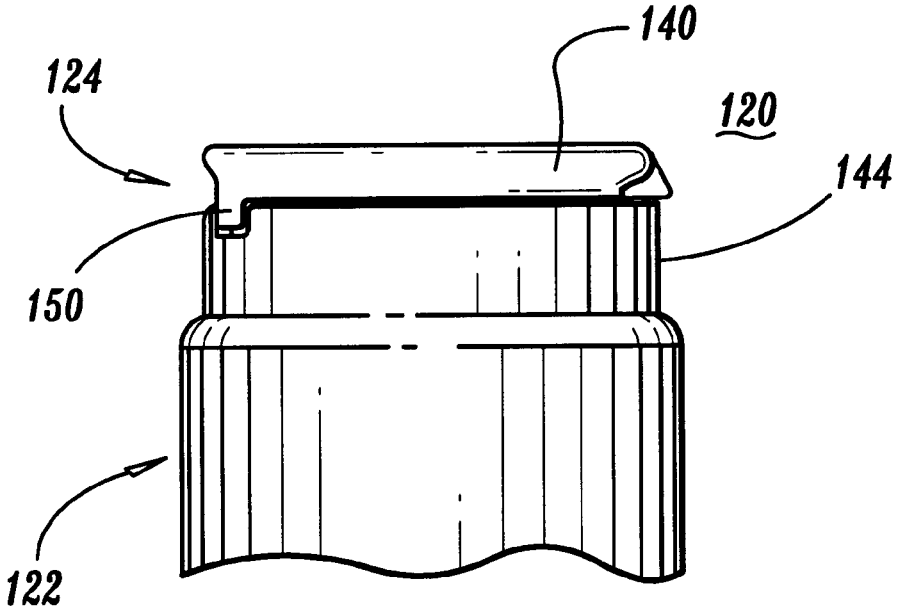
FIG. 17 is a side plan view of the product dispensing system illustrated in FIG. 16, shown in cutaway.

Referring to FIGS. 16 and 17, an alternate embodiment of product dispenser 20 is shown. In this embodiment, product dispenser 20, similar to that described above, includes a plastic container 122, a closure 124 and does not include a tamper evident feature. A closing lid portion 140 is integrally assembled with a retention collar 144 via a hinge member 150. Closing lid portion 140 pivots relative to and about hinge member 150. Closure 124 includes an orifice plug 142 and plastic container 122 includes an orifice 128. Orifice 128 and orifice plug 144 create a fluid and/or gas tight interface to preserve the integrity of a product contained within product dispenser 20. This fluid and/or gas tight interface includes a sealing engagement formed between orifice 128 and orifice plug 142 to prevent product leakage from product dispenser 20 and/or contamination of the product contained therein, similar to that described above. Product dispenser 120 is manufactured, assembled and operated, similar to that described above, without a tamper evident feature.

It will be understood that various modifications may be made to the embodiments disclosed herein. Therefore, the above descriptions should not be construed as limiting, but merely as exemplification of the various embodiments. Those skilled in the art will envision other modifications within the scope and spirit of the appended claims.

What is claimed is:

1. A dispenser comprising:

a container having a closed end that defines an orifice and at least one support post extending therefrom; and a closure being mountable about the closed end of the container and engageable with the at least one support post, the closure having a closing lid portion which includes an orifice plug configured to sealingly engage the orifice of the container, the closure including a retention collar disposed about an outer surface of the container and configured to facilitate mounting of the closure to the container, the closing lid portion being movably connected to the retention collar, the closure further including a tamper evident portion being disposed about the closed end of the container and removably connecting the closing lid portion and the retention collar such that the tamper evident portion connects the closing lid portion and the retention collar to provide a first visual indication and the tamper evident portion is removable to provide a second visual indication.

2. A dispenser as recited in claim 1, wherein the closed end of the container has a pair of support posts extending therefrom configured to engage a surface of the closure.

3. A dispenser as recited in claim 1, wherein the container defines a keyway in an outer surface thereof and the closure includes an orientation key formed on an inner surface thereof that is receivable within the keyway, the orientation key and the keyway configured for engagement to facilitate mounting alignment of the container and the closure.

4. A dispenser as recited in claim 1, wherein a retention bead is formed about at least a portion of an outer surface of the container and being positionable adjacent to the closed end, the retention bead of the container configured to facilitate mounting of the closure to the container.

5. A dispenser as recited in claim 4, wherein the retention collar of the closure is configured to fixedly engage the retention bead of the container to facilitate fixedly mounting the closure to the container.

6. A dispenser as recited in claim 1, wherein the retention collar of the closure is movably connected to the closing lid portion via a hinge member.

7. A dispenser as recited in claim 1, wherein the orifice of the container defines an orifice bead configured to engage the orifice plug of the closure and facilitate sealing engagement therebetween.

8. A dispenser as recited in claim 1, wherein the tamper evident portion includes a tear band being circumferentially disposed about the closed end of the container.

9. A dispenser as recited in claim 8, wherein the tear band removably connects the closing lid portion and the retention collar.

10. A dispenser as recited in claim 9, wherein the tear band connects the closing lid portion and the retention collar to provide the first visual indication.

11. A dispenser as recited in claim 1, wherein the first visual indication indicates that the integrity of a product disposed within the container has not been compromised.

12. A dispenser as recited in claim 10, wherein the tear band is removable to provide the second visual indication.

13. A dispenser as recited in claim 12, wherein the second visual indication indicates that the closing lid portion is moveable between a closed position and an open position.

14. A dispenser as recited in claim 13, in the closed position, the orifice of the container and the orifice plug of the closure are in sealing engagement.

15. A dispenser as recited in claim 13, in the open position, the sealing engagement of the orifice of the container and the orifice plug of the closure is interrupted.

16. A dispenser as recited in claim 15, wherein the open position includes a range of movement of the closing lid portion between a first position and a second position.

17. A dispenser as recited in claim 16, in the second position, the closing lid portion is resiliently biased towards the first position.

18. A product dispenser comprising:

a tubular plastic container having a closed end and defining a longitudinal axis, the closed end defining an orifice and having a pair of support posts extending therefrom, the tubular plastic container defining a longitudinal keyway in an outer surface thereof and a retention bead formed about a portion of the outer surface and adjacent the closed end thereof; and a plastic closure mounted about the closed end of the plastic container and having a closing lid portion which includes an orifice plug configured for releasable sealing engagement with the orifice-of the plastic container, the closing lid portion having a tab portion for manipulation thereof, the plastic closure including a retention collar disposed about the outer surface of the plastic container and being moveably connected to the closing lid portion via a hinge member, the retention collar having a retention bead formed about a circumferential portion of an inner surface of the plastic closure and being configured to engage the retention bead of the plastic container to fixedly mount the plastic closure to the plastic container, the plastic closure further including an orientation key formed on the inner surface and being receivable within the longitudinal keyway of the plastic container, the orientation key and the longitudinal keyway engaging to facilitate mounting alignment of the plastic container, and the plastic closure further including a tamper evident portion including a tear band being circumferentially disposed about the closed end of the plastic container and removably connecting the closing lid portion and the retention collar such that the tear band connects the closing lid portion and the retention collar to provide a first visual indication, the first visual indication indicating that the integrity of a product disposed within the plastic container has not been compromised, the tear band being removable to provide a second visual indication, the second visual indication indicating that the closing lid portion is moveable between a closed position whereby the orifice of the plastic container and the orifice plug of the plastic closure are maintained in sealing engagement and an open position whereby the sealing engagement of the orifice and the orifice plug is interrupted, wherein the open position includes a range of movement of the closing lid portion between a first position whereby sealing engagement between the orifice and the orifice plug is interrupted and a second position whereby the closing lid portion is resiliently biased towards the first position.

19. A method of using a dispenser comprising the steps of:

providing a dispenser which includes:

a container having an orifice and at least one support post extending therefrom, and a closure including an orifice plug and a tamper evident portion, the closure being engageable with the at least one support post;

mounting the closure with the container such that the orifice and the orifice plug are in scaling engagement and the tamper evident portion indicates a first visual indication; and removing the tamper evident portion from the closure to indicate a second visual indication.

20. A method as recited in claim 19, wherein the step of providing farther includes the closure having a closing lid portion and the method further including a step of manipulating the closing lid portion between a closed position, whereby the orifice of the container and the orifice plug of the closure are in sealing engagement, and an open position an open position, whereby the sealing engagement of the orifice of the container and the orifice plug of the closure is interrupted.

21. A dispenser comprising:

a container having an end that defines an opening, the container further defining a keyway in an outer surface thereof; and a closure being mountable to the end of the container and sealingly engageable with the opening, the closure defining an orientation key engageable with the keyway.

* * * * *

UNITED STATES PATENT AND TRADEMARK OFFICE

CERTIFICATE OF CORRECTION

PATENT NO. : 6,318,605 B1
DATED : November 20, 2001
INVENTOR(S) : Nyman et al.

It is certified that error appears in the above-identified patent and that said Letters Patent is hereby corrected as shown below:

Column 14, claim 19,
Line 16, replace "scaling" with -- sealing --.

Column 14, claim 20,
Line 23, replace "farther" with -- further --.

Signed and Sealed this

Second Day of April, 2002

*Attest:*

*Attesting Officer*

JAMES E. ROGAN
*Director of the United States Patent and Trademark Office*